US006167865B1

(12) United States Patent
Ma

(10) Patent No.: US 6,167,865 B1
(45) Date of Patent: Jan. 2, 2001

(54) INTAKE SYSTEM FOR AN INTERNAL COMBUSTION ENGINE

(75) Inventor: Thomas Tsoi-Hei Ma, Ferrers (GB)

(73) Assignee: Ford Global Technologies, Inc., Dearborn, MI (US)

( * ) Notice: Under 35 U.S.C. 154(b), the term of this patent shall be extended for 0 days.

(21) Appl. No.: 09/319,836

(22) PCT Filed: Dec. 11, 1997

(86) PCT No.: PCT/GB97/03419

§ 371 Date: Jun. 10, 1999

§ 102(e) Date: Jun. 10, 1999

(87) PCT Pub. No.: WO98/26175

PCT Pub. Date: Jun. 18, 1998

(30) Foreign Application Priority Data

Dec. 13, 1996 (GB) ..... 96259494

(51) Int. Cl.[7] ..... F02M 25/07; F02M 25/08; F02M 35/108

(52) U.S. Cl. ..... 123/308; 123/184.42; 123/184.59; 123/306; 123/430; 123/518; 123/568.17

(58) Field of Search ..... 123/184.42, 184.47, 123/184.53, 184.59, 306, 308, 432, 430, 518, 519, 520, 568.11, 568.17

(56) References Cited

U.S. PATENT DOCUMENTS 4,174,686 * 11/1979 Shimizu et al. ..... 123/308
5,329,912 * 7/1994 Matsumoto et al. ..... 123/308
5,653,202 * 8/1997 Ma ..... 123/184.59 X

FOREIGN PATENT DOCUMENTS

473931 * 7/1991 (EP) .

* cited by examiner

*Primary Examiner*—Tony M. Argenbright
(74) *Attorney, Agent, or Firm*—Jerome R. Drouillard

(57) ABSTRACT

An intake system for an internal combustion engine includes an intake manifold having a plenum connected to ambient air by a main throttle and branches leading from the plenum to an intake port of each cylinder. A storage pipe is connected and parallel with each of the intake manifold branches. Gases from an auxiliary supply are drawn by the intake manifold vacuum into the storage pipe and thence into the engine cylinders.

21 Claims, 2 Drawing Sheets

INTAKE SYSTEM FOR AN INTERNAL COMBUSTION ENGINE

FIELD OF THE INVENTION

The present invention relates to an intake system of an internal combustion engine having a plurality of cylinders, at least one intake valve per cylinder and an intake port leading to the intake valve, the intake system comprising an intake manifold having a plenum connected to ambient air by way of a main throttle and having a plurality of branches each leading from the plenum to an intake port of a respective one of the engine cylinders.

BACKGROUND OF THE INVENTION

In exhaust gas recirculation (EGR) systems, it is known to achieve improved dynamic response to sudden changes in EGR flow by delivering the EGR gases directly to each intake port and avoiding the transport delay through the plenum chamber and branches of the intake manifold as experienced in conventional EGR. Such systems are sometimes termed "ported EGR" systems. A disadvantage of ported EGR is increased risk of unstable combustion because a substantial segment of the intake manifold branch is back-filled with EGR gases during a large part of the engine cycle, forming a stratified column within the branch caused by gases being drawn continuously by the prevailing manifold vacuum and stored along the length of the branch during the period when the associated intake valve is closed. During the intake period, this column containing a long segment of EGR gases followed by intake air is drawn sequentially into the engine cylinder and unless the charge is well mixed within the combustion chamber, isolated pockets of EGR gases may persist causing combustion instability.

It has also been proposed to improve combustion stability by controlling the stratification of the air and EGR gases. WO95/22687 achieves charge stratification by storing EGR gases as a column in a branch of the intake manifold. The EGR gases and the air enter the combustion chamber consecutively and as a result the charge is vertically stratified with the EGR gases that enter the cylinder first concentrated at the bottom of the cylinder and the air that enters last concentrated at the top.

The present invention is also concerned with an engine in which a stream of gases, such as EGR or fuel vapour, is stored as a column in the intake manifold to be drawn into the cylinder separately from the main air charge to form a stratified charge within the engine combustion chamber.

SUMMARY OF THE INVENTION

According to the present invention, there is provided an intake system of an internal combustion engine having a plurality of cylinders, at least one intake valve per cylinder and an intake port leading to the intake valve, the intake system comprising an intake manifold having a plenum connected to ambient air by way of a main throttle and having a plurality of branches each leading from the plenum) to an intake port of a respective one of the engine cylinders, a plurality of storage pipes each connected in parallel with a respective one of the branches of the intake manifold, each storage pipe opening at one end into the plenum and opening at the other end into the associated intake port, and a plurality of auxiliary pipes connecting an auxiliary gas supply to a point along the storage pipe, wherein the position along the storage pipe of the connection with the auxiliary pipe is such that when the associated intake valve is closed, gases from the auxiliary supply are drawn by intake manifold vacuum only into the storage pipe, whereby, when the associated intake valve is subsequently opened, air from the branch of the intake manifold and gases from the auxiliary supply stored in the storage pipe enter the cylinder as parallel streams to form within the cylinder stratified regions of air and gases from the auxiliary supply.

The auxiliary supply may either be a pipe connected to the exhaust system to supply EGR gases to the cylinders or it may be a vapour source deriving fuel vapours from the fuel storage tank for the engine, a vapour storage canister communicating with the ullage space of the fuel storage tank or a vapour extraction system acting to separate the fuel supply to the engine into a liquid fraction and a vapour fraction.

In its application to recirculating exhaust gases, the present invention may be regarded as a variation on that in WO95/22687 and differs from it in that the EGR gases are stored in separate pipes from the intake branches and enter the cylinders at the same time as and in parallel with the air in the branches of the intake manifold. This allows a superior form of stratification that better survives the compression stroke of the piston. In the prior art, though the gases are vertically (or axially) stratified at the end of the intake stroke, they tend to mix by the end of the compression stroke. The present invention on the other hand allows radial or lateral stratification of the charge in which the swirling gases can remain in the same relative position even after compression.

The same considerations of maintaining improved stratification even during the compression stroke applies to engines in which the auxiliary supply of gases is a fuel vapour supply intended to provide an easily ignitable cloud that resides in the vicinity of the spark plug gap at the time of ignition.

BRIEF DESCRIPTION OF THE DRAWINGS

The invention will now be described further, by way of example, with reference to the accompanying drawing, in which.

DETAILED DESCRIPTION OF THE PREFERRED EMBODIMENTS

Figure 1:
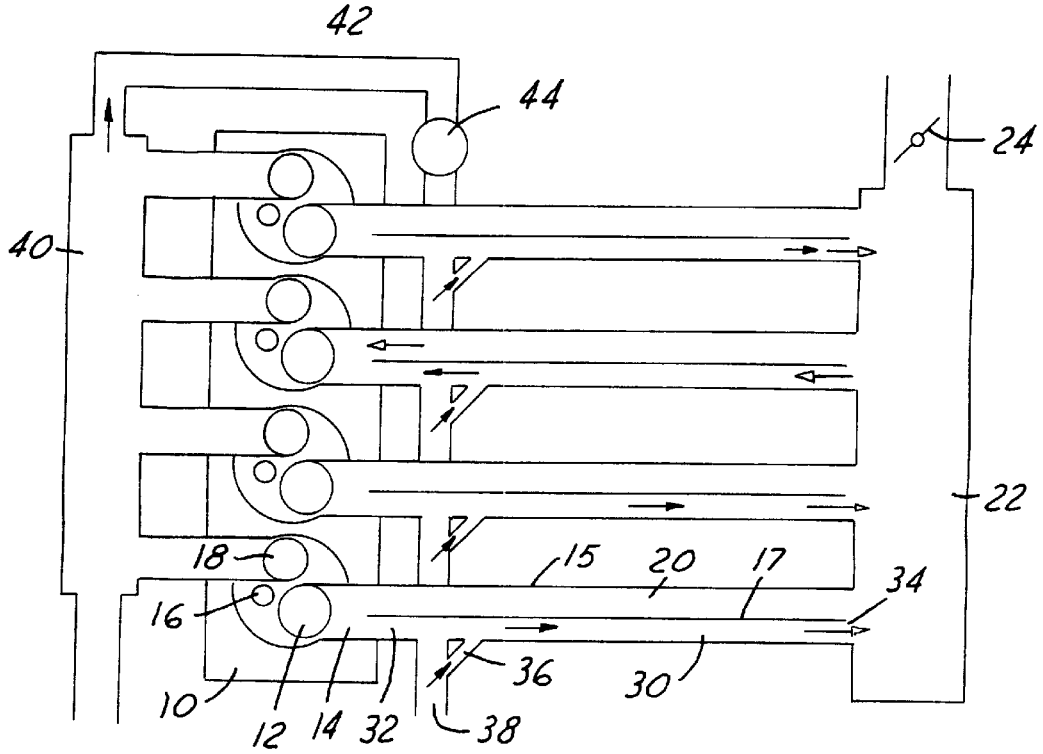
FIG. 1 is a schematic representation of an embodiment of the invention in which the auxiliary supply is an EGR supply and FIG. 2 is a schematic representation of an embodiment of the invention in which the auxiliary supply is a fuel vapour supply.

In FIG. 1, an internal combustion engine 10, shown as a spark ignition engine, has four cylinders each having an intake valve 12, an exhaust valve 18 and a spark plug 16. The intake valve 12 is supplied with air by an intake port 14 which is connected by a pipe 15 to a plenum 22 of the intake manifold. The plenum 22 is connected to ambient air by way of a main throttle 24 in the usual manner.

Each pipe 15 is divided by a wall 17 into two passages 20 and 30. The passages 20 are branches of the intake manifold and the passages 30 act as storage pipes for EGR gases as will now be described.

Each storage pipe 30 is connected in parallel with a respective intake branch 20 and has one end 34 opening into the plenum 22 and the other end 32 opening into the intake port 14. Between the ends 32 and 34, the storage pipes are connected to EGR pipes 36 which branch from an EGR manifold 38 that is connected by way of an EGR regulating valve 44 and a pipe 42 to the exhaust manifold 40 of the engine 10. The pipes 36 are connected nearer to the ends 32 of the storage pipes 30 that open into the intake ports 14 but are inclined towards the ends 34 opening into the plenum 22.

For ease of reference the cylinders of the engine will be numbered 1 to 4 starting from the uppermost cylinder in the drawing as viewed. The engine is shown with cylinder 1 during the exhaust stroke, cylinder 2 during the intake stroke, cylinder 3 during the expansion stroke and cylinder 4 during the compression stroke. Cylinder 2 has an open intake valve and air is drawn into this cylinder creating a partial vacuum in the plenum 22. In the meantime all the other intake valves are closed. The partial vacuum in the plenum 22 results in EGR gases being drawn into the storage pipes 30 from the EGR pipe 36 for cylinders 1, 3 and 4 during three of the four strokes of each cylinder when the intake valve is closed, the EGR gases being drawn into and stored in the storage pipes 30 as shown by the shaded regions in the drawing. The length of the storage pipe 30 should be sufficient to ensure that the EGR gases never spill over into the plenum 22 nor into the intake branches 20 while the intake valve of the associated cylinder is closed.

As soon as the intake valve opens, as in the case of the illustrated cylinder 2, the stored EGR gases in the storage pipe 30 and air from the intake manifold branch 20 enter the cylinder at the same time and in parallel with one another, the illustrated geometry of the intake port being design to promote swirl or radial stratification in the cylinder, though it may alternatively be designed to promote tumble or lateral stratification. After the stored EGR gases have been exhausted, EGR gases directly from the EGR pipe 36 enter the cylinder, as shown for cylinder 2.

It can thus be seen that by storing EGR gases and allowing them to enter the cylinders at the same time as the air, one may achieve any desired form of stratification and one is not restricted to an axial or vertical stratification described in WO95/22687.

The EGR regulating valve 44 controls the rate at which EGR gases are drawn from the exhaust system and therefore the proportion of EGR dilution in the cylinder. When the EGR regulating valve 44 is fully closed, then there is no EGR flow and the storage pipe 30 conducts air. Hence under full load operation, without the need to take any special steps to redirect the intake air, the full cross-section of the pipe 15 becomes available for intake air and the breathing of the engine is not affected.

The embodiment of the invention shown in FIG. 1 relates to an engine having only one intake valve per cylinder and in which the geometry of the intake port is designed to promote swirl producing radially stratified layers across the diameter of the cylinder. It will however be appreciated that the invention can also be applied to an engine in which the stratification is achieved by tumble having two or more vertical stratified layers across the width of the cylinder. Furthermore the intake port leading to the intake valve may be partitioned to maintain the separation between the parallel streams of air and EGR closer to the intake valve.

Figure 3:
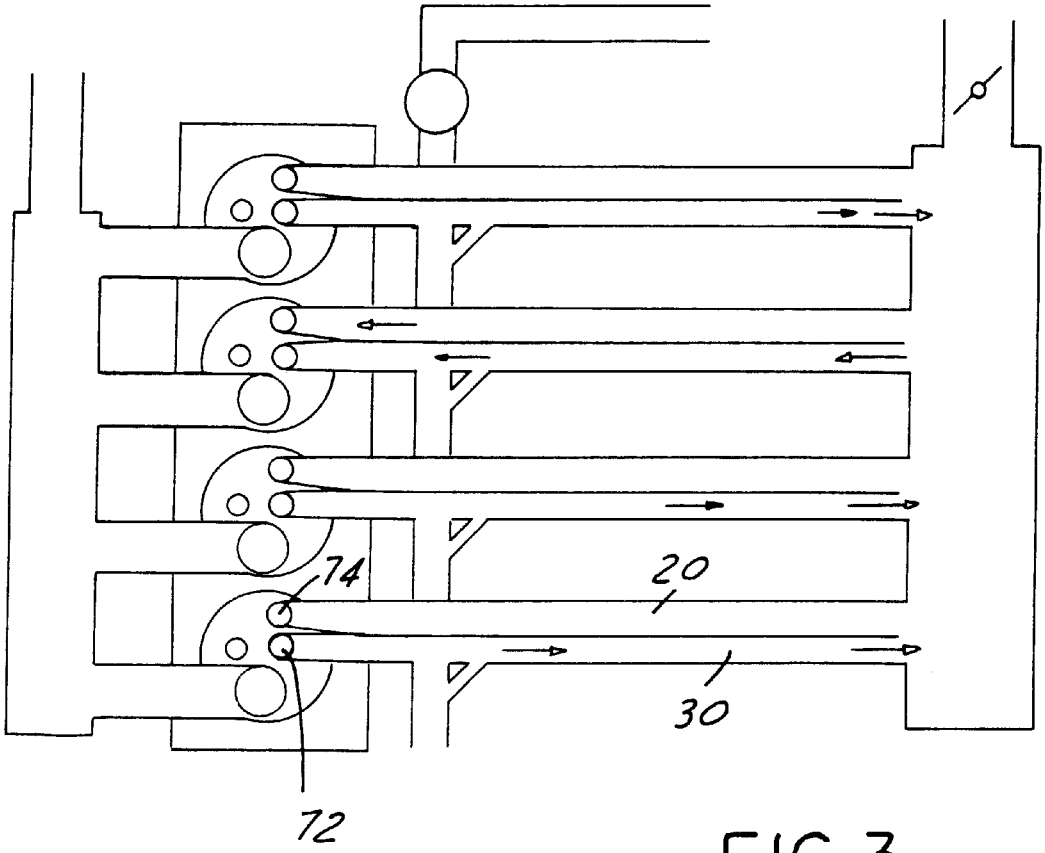
FIG. 3 is a schematic representation of an embodiment of the invention in which two intake valves service each cylinder.

The invention can also be applied to an engine in which each cylinder has two intake valves supplied by a common intake port. In this case, the storage pipe 30 may be positioned to face partially or entirely one of the intake valves while the branch 20 of the intake manifold supplying air to the cylinder may face the other intake valve. This construction is shown in FIG. 3, wherein valve 72 controls the flow through storage pipe 30 and valve 74 controls the flow through branch 20.

Figure 2:
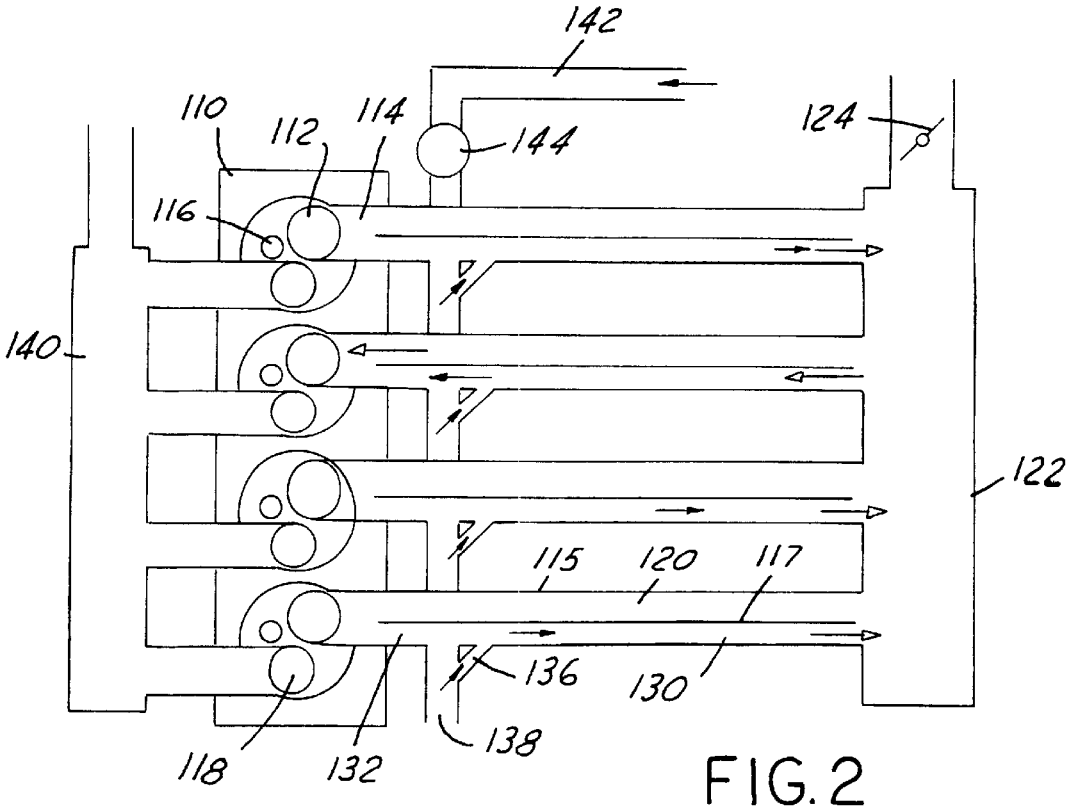

The embodiment of the invention shown in FIG. 2 is essentially the same as that of FIG. 1 and to avoid unnecessary repetition like parts have been allocated similar numbers in the 100 series. The essential difference lies in the fact that in place of an EGR supply pipe 42, the pipe 142 is connected to an auxiliary supply of fuel vapour. This supply could be a vapour storage canister for evaporative emissions control, the ullage space of the fuel storage tank or a vapour extractor that separates the fuel supply into higher and lower boiling point fractions. As with EGR, it is desirable to achieve charge stratification but in this case the vapour is required near the spark plug as it improves combustion. Hence, the storage pipes 130 in FIG. 2 lead to the centres of the combustion chambers rather than their peripheries.

What is claimed is:

1. An intake system of an internal combustion engine having a plurality of cylinders, at least one intake valve per cylinder, and an intake port leading to the intake valve, the intake system comprising:

an intake manifold having a plenum connected to ambient air by way of a main throttle;

a plurality of branches each leading from the plenum to the respective intake port of a respective one of the engine cylinders;

a plurality of storage pipes each connected in parallel with a respective one of the branches of the intake manifold, each storage pipe opening at a first end into the plenum and opening at a second end into the associated intake port;

a plurality of auxiliary pipes connecting an auxiliary gas supply at a respective position along each of the storage pipes, each of the positions along each of the storage pipes of the connection with the auxiliary pipe is such that when the associated intake valve is closed, a portion of the gas from the auxiliary supply is drawn by an intake manifold vacuum only into the storage pipe, and when the associated intake valve is subsequently opened, air form the associated branch of the intake manifold and the gas from the auxiliary supply stored in the storage pipe enter the cylinder as parallel streams to form stratified regions of air and gases from the auxiliary supply within the cylinder.

2. An intake system as claimed in claim 1, wherein the auxiliary gas supply comprises an EGR pipe connected to the engine exhaust system and operative to supply exhaust gases for recirculation to the intake system.

3. An intake system as claimed in claim 1, wherein the auxiliary gas supply comprises a pipe connected to a fuel vapor source.

4. An intake system as claimed in claim 3 where wherein the end of each auxiliary pipe opening into a storage pipe is inclined to the axis of the storage pipe to direct the gases from the auxiliary supply towards the plenum of the intake manifold.

5. An intake system as claimed in claim 4, wherein the end of each auxiliary pipe opening into a storage pipe is inclined to the axis of the storage pipe to direct the gases from the auxiliary supply towards the plenum of the intake manifold.

6. An intake system as claimed in claim 5, wherein the end of each auxiliary pipe opening into a storage pipe is inclined to the axis of the storage pipe to direct the gases from the auxiliary supply towards the plenum of the intake manifold.

7. An intake system as claimed in claim 6, wherein each of the auxiliary pipes comprise branches of a manifold having a common plenum connected to the auxiliary supply by way of a flow regulating valve.

8. An intake system as claimed in claim 7, wherein each of the auxiliary pipes comprise branches of a manifold having a common plenum connected to the auxiliary supply by way of a flow regulating valve.

9. An intake system as claimed in claim 8, wherein each of the auxiliary pipes comprise branches of a manifold having a common plenum connected to the auxiliary supply by way of a flow regulating valve.

10. An intake system as claimed in claim 9, wherein each of the auxiliary pipes comprise branches of a manifold having a common plenum connected to the auxiliary supply by way of a flow regulating valve.

11. An intake system as claimed in claim 10, wherein the storage pipes are formed providing a portion in the branches lading from the plenum to the intake ports, a passage to a first side of each of the partitions each comprising the branches of the intake manifold and a passage to the second side of each of the partitions each comprising the storage pipes.

12. An intake system as claimed in claim 11, wherein the storage pipes are formed providing a portion in the branches lading from the plenum to the intake ports, a passage to a first side of each of the partitions each comprising the branches of the intake manifold and a passage to the second side of each of the partitions each comprising the storage pipes.

13. An intake system as claimed in claim 12, wherein the storage pipes are formed providing a portion in the branches lading from the plenum to the intake ports, a passage to a first side of each of the partitions each comprising the branches of the intake manifold and a passage to the second side of each of the partitions each comprising the storage pipes.

14. An intake system as claimed in claim 13, wherein the storage pipes are formed providing a portion in the branches lading from the plenum to the intake ports, a passage to a first side of each of the partitions each comprising the branches of the intake manifold and a passage to the second side of each of the partitions each comprising the storage pipes.

15. An intake system as claimed in claim 14, wherein the storage pipes are formed providing a portion in the branches lading from the plenum to the intake ports, a passage to a first side of each of the partitions each comprising the branches of the intake manifold and a passage to the second side of each of the partitions each comprising the storage pipes.

16. A intake system as claimed in claim 15, for use with an engine having a first and second intake valve per cylinder supplied by a common intake port, further comprising the storage pipes and the intake manifold branches each having comparable flow cross-sectional areas, each of the storage pipes facing the first intake valves and each of the intake manifold branches facing the second one of the intake valves, respectively.

17. An intake system as claimed in claim 16, for use with an engine having a first and second intake valve per cylinder supplied by a common intake port, further comprising the storage pipes and the intake manifold branches each having comparable flow cross-sectional areas, each of the storage pipes facing the first intake valves and each of the intake manifold branches facing the second one of the intake valves, respectively.

18. A intake system as claimed in claim 17, for use with an engine having a first and second intake valve per cylinder supplied by a common intake port, further comprising the storage pipes and the intake manifold branches each having comparable flow cross-sectional areas, each of the storage pipes facing the first intake valves and each of the intake manifold branches facing the second one of the intake valves, respectively.

19. A intake system as claimed in claim 18, for use with an engine having a first and second intake valve per cylinder supplied by a common intake port, further comprising the storage pipes and the intake manifold branches each having comparable flow cross-sectional areas, each of the storage pipes facing the first intake valves and each of the intake manifold branches facing the second one of the intake valves, respectively.

20. An intake system as claimed in claim 19, for use with an engine having a first and second intake valve per cylinder supplied by a common intake port, further comprising the storage pipes and the intake manifold branches each having comparable flow cross-sectional areas, each of the storage pipes facing the first intake valves and each of the intake manifold branches facing the second one of the intake valves, respectively.

21. An intake system as claimed in claim 20, for use with an engine having a first and second intake valve per cylinder supplied by a common intake port, further comprising the storage pipes and the intake manifold branches each having comparable flow cross-sectional areas, each of the storage pipes facing the first intake valves and each of the intake manifold branches facing the second one of the intake valves, respectively.

* * * * *